US012338060B2

(12) United States Patent
Lipp

(10) Patent No.: US 12,338,060 B2
(45) Date of Patent: Jun. 24, 2025

(54) LARGE CONTAINER AND METHOD FOR PRODUCING A LARGE CONTAINER

(71) Applicant: XL Beteiligungen GmbH & Co. KG, Tannhausen (DE)

(72) Inventor: Manuel Lipp, Ellwangen (DE)

(73) Assignee: XL Beteiligungen GmbH & Co. KG, Tannhausen (DE)

( * ) Notice: Subject to any disclaimer, the term of this patent is extended or adjusted under 35 U.S.C. 154(b) by 0 days.

(21) Appl. No.: 18/008,802

(22) PCT Filed: Jun. 9, 2021

(86) PCT No.: PCT/EP2021/065426

§ 371 (c)(1),
(2) Date: Dec. 7, 2022

(87) PCT Pub. No.: WO2021/250078

PCT Pub. Date: Dec. 16, 2021

(65) Prior Publication Data

US 2023/0227247 A1 Jul. 20, 2023

(30) Foreign Application Priority Data

Jun. 10, 2020 (DE) ..... 10 2020 115 374.0

(51) Int. Cl.
*B21C 37/12* (2006.01)
*B65D 88/12* (2006.01)
*B65D 90/08* (2006.01)

(52) U.S. Cl.
CPC ..... *B65D 88/125* (2013.01); *B21C 37/122* (2013.01); *B65D 90/08* (2013.01)

(58) Field of Classification Search
CPC ..... B21C 37/122; B65D 90/08; B65D 90/06; B65D 88/08; B65D 88/126; E04H 7/065
See application file for complete search history.

(56) References Cited

U.S. PATENT DOCUMENTS 2,114,513 A 4/1938 Wilkin
2,668,634 A * 2/1954 Arne ..... E04H 7/14 220/4.12

(Continued)

FOREIGN PATENT DOCUMENTS

DE 87 04 454 U1 10/1987
DE 10 2015 004 281 A1 12/2015

(Continued)

*Primary Examiner* — Stephen J Castellano
(74) *Attorney, Agent, or Firm* — Donald S. Showalter, Esq.; GrayRobinson, P.A.

(57) ABSTRACT

Embodiments of a large container may include a container base and a circumferential container wall. An upper end of the wall is closed by a container cover in the form of a metal disc. An annular, circumferential support element is secured at an upper end region of the wall. The disc spans the upper open end of the container wall. A lower side of the disc is welded to the support element and/or to the upper end region of the container wall by a continuous first welding seam. An upper side and/or an edge of the disc is welded to the support element by a continuous second welding seam. The first and second weld seams have respective first and second roots which merge into one another or at least come together.

19 Claims, 4 Drawing Sheets

(56) References Cited

U.S. PATENT DOCUMENTS

| | | | | |
|---|---|---|---|---|
| 3,397,443 | A * | 8/1968 | Johansson | E04H 7/06 228/184 |
| 4,133,094 | A * | 1/1979 | Stafford | B23K 37/0417 29/447 |
| 7,743,582 | B1 | 6/2010 | Petricio Yaksic | |
| 10,246,211 | B2 | 4/2019 | Lipp | |
| 2020/0378144 | A1 * | 12/2020 | Belanger | B65D 90/024 |

FOREIGN PATENT DOCUMENTS

| | | | |
|---|---|---|---|
| DE | 10 2018 006 603 | A1 | 2/2019 |
| GB | 727023 | | 3/1955 |
| GB | 824992 | | 12/1959 |
| WO | 2019/178688 | A1 | 9/2019 |
| WO | 2020/038504 | A2 | 2/2020 |

* cited by examiner

LARGE CONTAINER AND METHOD FOR PRODUCING A LARGE CONTAINER

CROSS REFERENCE TO RELATED APPLICATIONS

This is a U.S. National Phase Entry under 35 U.S.C. § 371 of International Application No. PCT/EP2021/065426 filed Jun. 9, 2021 entitled: LARGE CONTAINER AND METHOD FOR PRODUCING A LARGE CONTAINER which designates the United States and at least one other country in addition to the United States and claims priority to German Patent Application No. 10 2020 115 374.0 filed Jun. 10, 2020.

STATEMENT REGARDING FEDERALLY-SPONSORED RESEARCH OR DEVELOPMENT

Not applicable.

INCORPORATION BY REFERENCE

International Application No. PCT/EP2021/065426 and German Patent Application No. 10 2020 115 374.0 are each expressly incorporated herein by reference in their entireties to form part of the present disclosure.

FIELD OF THE INVENTION

The invention relates to a large container, in particular a drinking-water container, a food container or a container for pharmaceutical products, having a container base and a circumferential container wall, which forms a receiving space, wherein an upper, open end of the container wall is closed by a container cover, which has at least a diameter of three meters (3 m).

The invention furthermore relates to a method for producing a large container, in particular a drinking-water container, food container, or container for pharmaceutical products, having a container base and a circumferential container wall, which forms a receiving space, according to which an upper, open end of the container wall is closed by a container cover, which has at least a diameter of three meters (3 m).

BACKGROUND

Large containers are known in various embodiments from the general prior art, in particular as storage containers for liquid, gaseous or solid products. The large containers known from the prior art usually have a capacity of forty cubic meters to fifty thousand cubic meters (40 to 50,000 $m^3$).

The known large containers have a container base and a circumferential container wall, which forms a receiving space. The container wall can be produced from any material, preferably from metal, concrete or metal-reinforced concrete, in particular steel or stainless steel or steel-reinforced concrete. Particularly if the large container is a drinking-water container, a food container or a container for pharmaceutical products, special requirements are placed on the large container in order to avoid contamination of the medium to be received.

Large containers are generally closed in an air-tight or gas-tight manner and optionally have an agitator and various instrumentation and control devices (I&C), for example for process control.

For large containers for storing drinking water, food and pharmaceutical products, it is advisable to construct the container wall from metal, in particular stainless steel. It is particularly advantageous if the container wall is formed by sheet-metal strips which are welded together. For this purpose, it is possible, in particular, to use an endless strip method to form the container wall from sheet-metal strips.

The container base can be of any desired design, and the base is preferably formed by steel plates, in particular stainless steel plates, and/or concreted.

The containers known from the prior art, in which an upper, open end of the container wall is closed by a container cover, usually have a conical cover. Such container covers are used, in particular, for drinking-water containers, food containers or for containers for pharmaceutical products. The conical covers are formed from metal, in particular stainless steel, especially if a drinking-water container is concerned, in order to meet the standards applicable for the storage of drinking water.

One disadvantage of the conical covers known from the prior art is that the construction of the container cover is complex. Use must be made of a suitable supporting structure which supports the conical cover. Furthermore, for reasons of stability, the metal plates necessary for the formation of the container cover must have a minimum thickness, resulting in correspondingly high material costs.

The prior art also discloses large containers for storing products, in particular waste materials, where the container cover is designed as a flat cover, that is, where the cover surface runs flat or horizontally.

To fasten the flat cover, provision is made to connect it to the upper, open end of the container wall by clamping. For this purpose, to increase stability, provision can be made for a flange or a reinforcing ring to be attached to the upper side of the flat cover. Although a stable and tight connection between the flat cover and the container wall can be produced by clamping, this also gives rise to dead spaces or gaps and untreated zones, which are unsuitable for contamination-free storage. Therefore, the known container covers which are designed as flat covers are not suitable for large containers in which contamination-free storage is necessary, and this applies especially to drinking-water containers, food containers or containers for pharmaceutical products.

BRIEF SUMMARY OF THE INVENTION

The underlying object of the present invention is that of providing a large container, in particular a drinking-water container, a food container or a container for pharmaceutical products, which eliminates the disadvantages of the prior art, in particular makes possible storage of the media to be received in a way which is as free as possible from contamination.

The underlying object of the present invention is furthermore that of providing a method for producing a large container, in particular a drinking-water container, a food container or a container for pharmaceutical products, which method eliminates the disadvantages of the prior art, in particular enables the production of a large container which is as free as possible from contamination.

The large container according to the invention, in particular a drinking-water container, a food container or a container for pharmaceutical products, has a container base and a circumferential container wall, which forms a receiving space. An upper, open end of the container wall is closed by a container cover, which has at least a diameter of three meters (3 m). According to the invention, to an annularly encircling support element is fixed on an upper end region of the container wall, wherein the container cover is designed as a metal disc which spans the upper, open end of the container wall in a self-supporting manner and closes said end by virtue of the fact that to a lower side of the metal disc, which lower side faces the receiving space, preferably a circumferential edge of the metal disc, is welded to the support element and/or to the upper end region of the container wall in a gas-tight or liquid-tight manner by means of a continuous first weld seam.

The lower side of the metal disc is preferably welded to the support element.

According to the invention, provision is made for a circumferential edge of the metal disc and/or an upper side of the metal disc to be welded to the support element in a gas-tight or liquid-tight manner by means of a continuous second weld seam.

As an alternative or in addition to a second weld seam, provision can also be made, for example, for the circumferential edge of the metal disc to be adhesively bonded, riveted, screwed or fastened in some other way to the support element on an upper side of the metal disc.

In principle, it is also possible for even more weld seams to be provided in addition to the first weld seam and the second weld seam. Preferably, however, only the first weld seam and optionally the second weld seam are provided in order to secure the metal disc.

In the sense according to the invention, a continuous weld seam is also to be understood to mean a weld seam which has been produced from a plurality of sections. The continuous weld seam therefore does not necessarily have to be produced in a continuous operation.

The inventor has recognized that a combination of the aforementioned features can be used to create a large container which enables products to be stored in a particularly low-contamination or contamination-free manner and can be produced efficiently and in a reliable process. A large container of this type is suitable, in particular, for storing drinking water, food or pharmaceutical products.

The term "metal disc" does not mean that this must be a circular metal disc. Nevertheless, it is preferable to make the metal disc circular for the large container according to the invention. In the sense according to the invention, however, a metal disc should be understood in the first instance to mean, in general, a flat or level metal surface which, in plan view, can have any desired shape, for example an elliptical, rectangular, square or a freely selectable shape.

Fixing an annularly encircling support element on an upper end region of the container wall provides a container cover support element which is particularly suitable and can be designed independently of the container wall. By virtue of the configuration, provided according to the invention, of the container cover as a metal disc which spans the upper, open end of the container wall in a self-supporting manner, a cover construction which is particularly light is selected. In this case, it is particularly suitable if the metal disc is of thin design. Such metal discs designed as container covers are also referred to in the prior art as diaphragm covers. A design of the metal disc such that it spans the upper, open end of the container wall in a self-supporting manner can be achieved at comparatively low cost by dispensing with braces, pillars, beams or reinforcing elements.

The metal disc according to the invention spans the upper, open end of the container wall without pillars and beams.

According to the invention, it is now envisaged that the upper, open end of the container wall is closed by virtue of the fact that to a lower side of the metal disc, which lower side faces the receiving space, is welded in a gas-tight or liquid-tight manner to the support element and/or to the upper end region of the container wall by means of a continuous first weld seam. As an option, the circumferential edge or the upper side of the metal disc can additionally be welded to the support element by means of a continuous second weld seam. By welding the metal disc, in particular the edge of the metal disc, to the support element, a dead space present in the prior art (clamping) can preferably be avoided.

By welding by means of a weld seam, two weld seams or even more weld seams, which weld the metal disc to the support element from the lower side and from the upper side, both a dead space or gaps as well as untreated zones are preferably avoided. With this type of welding, there is no risk of corrosion at this location.

The metal disc thus spans the upper, open end in a self-supporting manner and is supported only by the annular support element.

By combining the abovementioned measures, it is thus possible to produce a stable, low-contamination or contamination-free large container which can be produced efficiently.

A further advantage of the solution according to the invention is that the variety of parts is reduced. To produce a large container of this kind, it is sufficient to provide a support element and a metal disc matched thereto as a container cover for each diameter; these can be used for all containers with the same diameter, irrespective of the height of the container or the height of the container wall.

The large container according to the invention preferably has a receiving space with a capacity or volume of forty cubic meters to fifty thousand cubic meters (40 to 50,000 $m^3$). The diameter can preferably be three meters to fifty meters (3 m to 50 m). A volume of one hundred cubic meters to ten thousand cubic meters (100 to 10,000 $m^3$) and a diameter of five meters to forty meters (5 to 40 m) have proven to be particularly suitable for configuration of the large container as a drinking-water container.

It is advantageous if the metal disc spans the upper, open end of the container wall while running horizontally. However, the metal disc can also form a curved profile, for example an inwardly or outwardly curved profile.

In particular, at least slight sagging of the metal disc cannot always be completely avoided, despite the bracing additionally proposed below.

Because the metal disc spans the upper, open end while running horizontally, the overall height of the container is advantageously also lower than in the case of a conical cover.

It is advantageous if the metal disc is welded to the support element (or the upper end region of the container wall) without overlapping.

It has been found that a particularly advantageous connection can be produced between the metal disc and the support element if the metal disc is welded to the support element without overlapping. In this way, a dead space or a gap between the metal disc and the support element can be avoided in a particularly advantageous manner; furthermore, no untreated zones are formed. The first and the second weld seam can run directly adjacent to one another or toward one another.

It is advantageous if the outer diameter of the metal disc substantially corresponds to the inner diameter of the support element. The metal disc can thus be welded to the support element (or to the upper end region of the container wall) in a freely suspended manner without overlapping. By virtue of such a configuration, the metal disc can be welded to the support element, preferably an edge, in particular an outer edge of the support element facing the edge of the metal disc, in a particularly advantageous manner without dead spaces being created.

It is advantageous if the support element has, when viewed in cross section, at least two sections running at right angles to one another, wherein the support element is connected to the upper end region of the container wall in such a way that a first section of the support element runs substantially parallel to the container wall and is fixed on the container wall, and a second section of the support element runs substantially parallel to the metal disc.

It has been found that the support element offers particularly good stability and, furthermore, the metal disc can also be welded in place in a particularly advantageous manner if the support element has at least two sections running at right angles to one another.

The first section of the support element preferably extends the container wall upward. It is particularly preferable here if the first section of the support element runs plane-parallel or substantially plane-parallel to the container wall. That is to say that, if the container wall, when viewed from above, has a circular shape, the support element preferably also has a corresponding circular shape or a correspondingly adapted diameter.

It is advantageous if the second section extends radially outward from the end of the second section, which adjoins the first section.

It is advantageous if the support element is connected to the upper end region of the container wall by material bonding and/or by nonpositive engagement, preferably being welded thereto.

The annular support element can be connected to the container wall by any desired material bonding and/or nonpositive engagement method. Welding the support element to the container wall is particularly suitable. Provision can be made for the support element to be placed on the upper end or the upper edge of the container wall and to be connected there to the container wall by material bonding and/or nonpositive engagement, preferably by welding. Alternatively, provision can also be made for the support element to be welded to an inner side or an outer side of the container wall in the upper end region of the container wall, such that a first section of the support element and the upper end region of the container wall overlap.

According to the invention, provision can be made for the metal disc to be welded substantially to a transitional region between the first section and the second section of the support element by means of the first weld seam and/or the second weld seam.

It has proven to be particularly suitable if the metal disc is welded to a transitional region between the first section and the second section of the support element. The transitional region may be an edge, in particular an outer edge of the support element facing the edge of the metal disc. The fact that the first and (where applicable) the second weld seam weld the metal disc in each case in the transitional region between the first section and the second section results in a particularly stable connection, with a dead space or a gap and untreated zones being avoided.

It is advantageous if the support element is designed as a U-profile or as an angle profile in cross section.

A design of the support element as a U-profile or as an angle profile has proven to be particularly suitable. In principle, however, the support element can also be designed, for example, as a rectangular, for example square, or other profile.

The U-profile can be secured in different orientations.

The angle profile may, in particular, be a profile which is L-shaped in cross section. Provision may also be made in this context for the angle profile to have two sections of equal length when viewed in cross section.

According to the invention, provision can be made for the U-profile of the support element to be arranged in such a way that, when viewed in cross section, that end of the first section which faces away from the second section is adjoined by a third section, which runs substantially parallel to the second section, or, when viewed in cross section, that end of the second section which faces away from the first section is adjoined by a third section, which runs substantially parallel to the first section.

The two aforementioned orientations of the U-profile have proven particularly suitable in respect of stability. Furthermore, with the abovementioned orientations of the U-profile, the metal disc can also be connected to the support element in a particularly advantageous manner by means of the two weld seams.

It is advantageous if a root of the first weld seam and a root of the second weld seam come together or merge into one another.

It has been found to be particularly suitable, both in respect of particularly stable welding of the metal disc to the support element and in respect of the fact that dead spaces or gaps and untreated zones are to be avoided, if the two weld seams are set in such a way that the roots of the two weld seams come together or merge into one another. The result is therefore a double weld with joined roots.

The first and/or the second weld seam can preferably be of smooth design.

According to the invention, provision can be made for the metal disc to be designed as a thin and flexible metal disc.

It is advantageous if the metal disc is configured in such a way that the metal disc can be rolled up to form a roll and can be rolled out again in order to cover the upper end of the container wall.

In respect of the transport of the metal disc, it has been found to be particularly suitable if it can be rolled up to form a roll and can be rolled out as a flat cover to cover the upper end of the container wall. For this purpose, the metal disc is of correspondingly thin and flexible design.

According to the invention, provision can be made for the metal disc to be tensioned.

Tensioning of the metal disc has proven to be advantageous, in particular to ensure that the thin metal disc does not have any creases. The metal disc can be tensioned before the metal disc is welded to the support element.

It is advantageous if the metal disc has a thickness of zero point five millimeters to four point zero millimeters (0.5 to 4.0 mm), preferably zero point five millimeters to three point zero millimeters (0.5 to 3.0 mm), more preferably zero point five millimeters to two point five millimeters (0.5 to 2.5 mm), more preferably zero point eight millimeters to two point five millimeters (0.8 to 2.5 mm), even more preferably one point zero millimeters to two point zero millimeters (1.0 mm to 2.0 mm).

The aforementioned dimensions have proven to be particularly suitable for ensuring, on the one hand, that the metal disc has a suitable stability for spanning the open end of the container wall in a self-supporting manner and, on the other hand, that the material costs are kept as low as possible. Furthermore, the intrinsic weight of the metal disc should also be as low as possible to enable it to span the upper, open end of the container wall in a self-supporting manner.

According to the invention, provision can furthermore be made for the metal disc to be formed from a plurality of metal strips or plates which are welded to one another and preferably run parallel to one another.

It has proven to be particularly suitable to form the metal disc from a plurality of metal strips, which preferably run parallel to one another. In this case, production can preferably take place in the factory. The metal disc formed from the metal webs can then preferably be rolled up to form a roll. In the rolled-up form, the metal disc can then be transported particularly easily to the construction site and unwound there again and applied as a flat cover to the upper end of the container wall.

According to the invention, provision can be made for the container wall to be formed from metal, preferably by helically bent sheet-metal webs.

The production of container walls from metal, in particular from helically bent sheet-metal webs, is known from the prior art. A particularly suitable method is referred to as an endless strip method and serves to form container walls from sheet-metal strips. In these systems, steel strips are pre-profiled and welded to one another spirally on the inner side and on the outer side. In this case, it is possible to provide an integrally formed, circumferential reinforcing rib on the outer side, which ensures high stability during the absorption of static and dynamic loads. In this case, the inner side of the container is designed as an edgeless surface. A container produced by the endless strip method can be produced in a particularly advantageous manner on the construction site. In this case, the container grows upward in that in each case further sheet-metal webs are fed to the lower end of the container. In this case, the container cover according to the invention is preferably fitted before the container has reached its final height. The container cover is preferably installed when the container wall has a height of one meter to four meters (1 to 4 m), in particular two meters to three meters (2 to 3 m). This enables the weld seams to be set in a particularly advantageous way.

It is advantageous if the container wall is designed as a cylinder, preferably as a circular cylinder.

It has proven to be particularly suitable for the large container according to the invention if the container wall is designed as a cylinder, preferably as a circular cylinder. In this way, particularly high forces can be absorbed. Here, the metal disc is configured in a corresponding manner in plan view and preferably has the shape of a circular disc. Overall, the container thus has a cylindrical lateral surface or container wall.

Containers of this kind are suitable particularly for providing a receiving space with a volume of forty cubic meters to fifty thousand cubic meters (40 to 50,000 $m^3$) and preferably have a diameter of three meters to fifty meters (3 to 50 m). Large containers with a container wall which is designed as a circular cylinder and has a diameter of five meters to forty meters (5 to 40 m) and where the receiving space has a volume of one hundred cubic meters to ten thousand cubic meters (100 to 10,000 $m^3$). particularly suitable for drinking-water containers.

It has been found that stainless steel, preferably high-alloy, austenitic and ferritic-austenitic stainless steels, are particularly suitable as the material for the container wall and/or the support element and/or the metal disc and/or the container base. In this context, stainless steels with the European standardization material numbers 1.4404, 1.4571, 1.4162 and 1.4462 are particularly suitable.

It is particularly suitable if the container wall and/or the support element and/or the metal disc and/or the container base are/is formed from the same material.

A wall thickness of one point five millimeters to ten millimeters (1.5 to 10 mm), preferably two millimeters to six millimeters (2 to 6 mm), more preferably three millimeters to four millimeters (3 to 4 mm), in particular three millimeters (3 mm), has proven to be particularly suitable as the wall thickness for the container wall. The suitable wall thickness can be determined from the static requirements.

It is advantageous if the container base is formed from concrete, steel-reinforced concrete, preferably steel, in particular stainless steel. It can be advantageous if a foundation made of concrete or steel-reinforced concrete is provided and a container base made of steel, in particular stainless steel, is placed on this foundation. The container base can preferably be welded to a lower end of the container wall. The container base can preferably be formed from a plurality of metal strips or plates, which preferably run parallel to one another and are welded to one another.

The large container can be provided with further technical fittings. For example, in the case of a drinking-water container, an inlet and/or an outlet and/or an overflow (preferably with a siphon) and/or an excess pressure and vacuum valve and/or a lighting device and/or a dome cover and/or an air filter system and/or a manhole and/or a sight glass and/or a staircase system, if appropriate with landings and/or further fittings, agitators, pumps and supply lines, can be provided.

The large container according to the invention enables short construction times, high stability and on-site production using machines. The large container according to the invention has, in particular, smooth surfaces on the inner side of the container wall and of the support element, on the lower side of the metal disc and on the upper side of the container base, as a result of which the large container is contamination-free or low-contamination and permits easy cleaning and maintenance.

According to the invention, provision can furthermore be made for the support element to have, in cross section, a first side which runs substantially parallel to the container wall, and a second side which runs orthogonally thereto and runs substantially parallel to the metal disc.

The design of the support element such that it has, in cross section, a first side which runs substantially parallel to the container wall and a second side which runs orthogonally thereto and which runs substantially parallel to the metal disc has proven to be particularly suitable for fixing, in particular welding on, both the container wall and the metal disc.

It is advantageous if the support element rests flush both on the container wall and on the metal disc.

It is furthermore advantageous if the first weld seam and/or the second weld seam and/or further weld seams, in particular a weld seam which connects the support element to the container wall, are arranged or run in such a way that no dead space is formed. It is advantageous, in particular, if the second weld seam is arranged or runs in such a way that no dead space is formed between the metal disc and the support element, into which dead space drinking water can penetrate, for example.

According to the invention, provision can furthermore be made for the support element to have substantially the shape of a rectangle or a triangle in cross section.

Such a design is suitable, in particular, also in combination with a configuration of the support element in such a way that it has, in cross section, a first side which runs substantially parallel to the container wall, and a second side which runs orthogonally thereto and runs substantially parallel to the metal disc.

It has been found that the design of the support element to be at least rectangular or triangular in cross section is particularly suitable for producing a stable, efficient and low-cost large container, in particular for welding on the metal disc.

The support element can preferably be designed as a plate, in particular as an annular plate.

It is advantageous if the support element is composed of a plurality of annular segments, thus forming an annularly encircling support element. It may be particularly advantageous in this context if the support element is formed by annular plate segments. However, embodiment of the support element by annular segments is also suitable for all other cross-sectional shapes of the support element which are illustrated, especially also for support elements with a cross section which substantially has the shape of a rectangle or a triangle, or generally for a support element which, in cross section, has a first side which runs substantially parallel to the container wall and has a second side which runs orthogonally thereto and runs substantially parallel to the metal disc.

The annular segments can be welded, riveted, adhesively bonded or screwed together or connected to one another in some other positive, nonpositive or materially bonded manner.

A method according to the invention for producing a large container, in particular a drinking-water container, food container, or container for pharmaceutical products, having a container base and a circumferential container wall, which forms a receiving space, envisages that an upper, open end of the container wall is closed by a container cover, which has at least a diameter of three meters (3 m). According to the invention, it is envisaged here that an annularly encircling support element is fixed on an upper end region of the container wall, wherein the container cover is designed as a metal disc and is applied in such a way that the metal disc spans the upper, open end of the container wall in a self-supporting manner and closes said end by virtue of the fact that a circumferential gap between a lower side of the metal disc, which lower side faces the receiving space, and the support element (as a preferred option) and/or the upper end region of the container wall (as a less preferred option) is welded in a gas-tight or liquid-tight manner by means of a continuous first weld seam.

As an option, it is furthermore possible, in addition, for an upper side of the metal disc and/or a circumferential edge of the metal disc to be welded to the support element by means of a continuous second weld seam.

The method according to the invention provides a stable, low-contamination or contamination-free large container which can be erected efficiently and at low cost and which is suitable, in particular, for the storage of drinking water, food or pharmaceutical products.

It is envisaged here that an annularly encircling support element is first fixed on an upper end of the container wall. In this case, provision can be made for the support element to be connected to the upper end region of the container wall by material bonding and/or by nonpositive engagement, preferably being welded thereto. It is particularly preferable here if the support element is placed on an upper end of the container wall and welded to the upper end of the container wall, with the result that the support element extends the upper end of the container wall upward.

It is envisaged that, in the method according to the invention, the container cover is designed as a metal disc and is applied in such a way that the metal disc spans and closes the upper, open end of the container wall in a self-supporting manner, that is to say without pillars and beams. This is accomplished in that a circumferential gap between a lower side of the metal disc, which lower side faces the receiving space, and the support element and/or the upper end region of the container wall is welded in a gas-tight or liquid-tight manner by means of a continuous first weld seam. As an option, it is possible in addition for a circumferential edge of the metal disc to be welded to the support element by means of a continuous second weld seam on an upper side of the metal disc.

Here, the metal disc is preferably welded to the support element or to the upper end region of the container wall without overlapping, that is to say in such a way that the metal disc does not overlap the support element. As a result, the formation of a dead space or untreated zones is reliably avoided.

It is advantageous in the method according to the invention if the first weld seam and the second weld seam are set in such a way that a root of the first weld seam and a root of the second weld seam come together or merge into one another.

In the method according to the invention, provision can furthermore preferably be made for the metal disc to be designed as a thin and flexible metal disc.

To ensure that the metal disc is free of creases in the final state, provision can be made for it to be tensioned radially outward before the metal disc is welded to the support element by means of the first weld seam.

In the method according to the invention, it is advantageous if the metal disc is rolled up to form a roll and is rolled out again and optionally tensioned to cover the upper end of the container wall.

It has proven to be particularly advantageous if the metal disc is applied by first rolling it up as a roll and, for example, bringing it from the production site to the construction site and unrolling it again there. In this case, the metal disc can preferably be produced at the production site in such a way that it has the desired dimensions in order, after the metal disc has been welded to the support element and/or to the upper end region of the container wall, to close the upper end of the container wall in a gas-tight or liquid-tight manner.

The metal disc can preferably be what is referred to as a diaphragm cover, which is thin and so flexible that the metal disc can be rolled up, in particular for transport purposes.

The thicknesses of the metal disc which have already been mentioned in relation to the large container according to the invention are particularly suitable for this purpose.

It is furthermore especially suitable if the metal disc is formed from a plurality of metal strips which are welded to one another and preferably run parallel to one another.

Furthermore, it is especially suitable for the method according to the invention if the container wall is formed from metal, preferably by helically bent sheet-metal webs, preferably made of stainless steel, in particular in the way known from the endless strip method.

Features which have already been described in connection with the large container according to the invention can, of course, also be implemented advantageously for the method according to the invention and vice versa. Furthermore, advantages which have already been mentioned in connection with the large container according to the invention can also be understood to relate to the method according to the invention and vice versa.

In addition, it should be noted that terms such as "comprising", "having" or "with" do not exclude other features or steps. Furthermore, terms such as "a" or "the" which indicate a singular number of steps or features do not exclude a plurality of features or steps—and vice versa.

Exemplary embodiments of the invention are described in greater detail below with reference to the drawing drawings.

The figures each show preferred exemplary embodiments in which individual features of the present invention are illustrated in combination with one another. Features of an exemplary embodiment can also be implemented separately from the other features of the same exemplary embodiment and can accordingly be readily combined with features of other exemplary embodiments by a person skilled in the art to form further useful combinations and sub combinations.

In the figures, functionally identical elements are provided with the same reference signs. The figures are schematic.

DETAILED DESCRIPTION OF PREFERRED EMBODIMENTS

Large containers and methods for producing a large container are known in principle from the prior art, for which reason only the features which are essential for the invention are described in more detail below.

Figure 1:
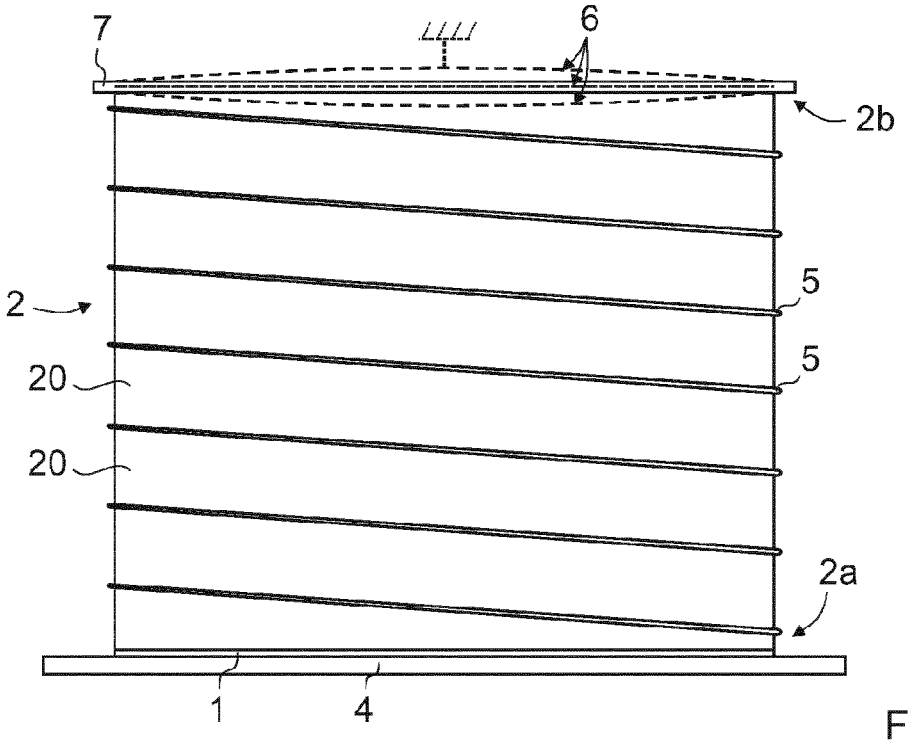
FIG. 1 shows a side view of a large container according to the invention.

FIG. 1 shows a side view of a large container which is suitable particularly as a drinking-water container, as a food container or as a container for pharmaceutical products.

Figure 2:
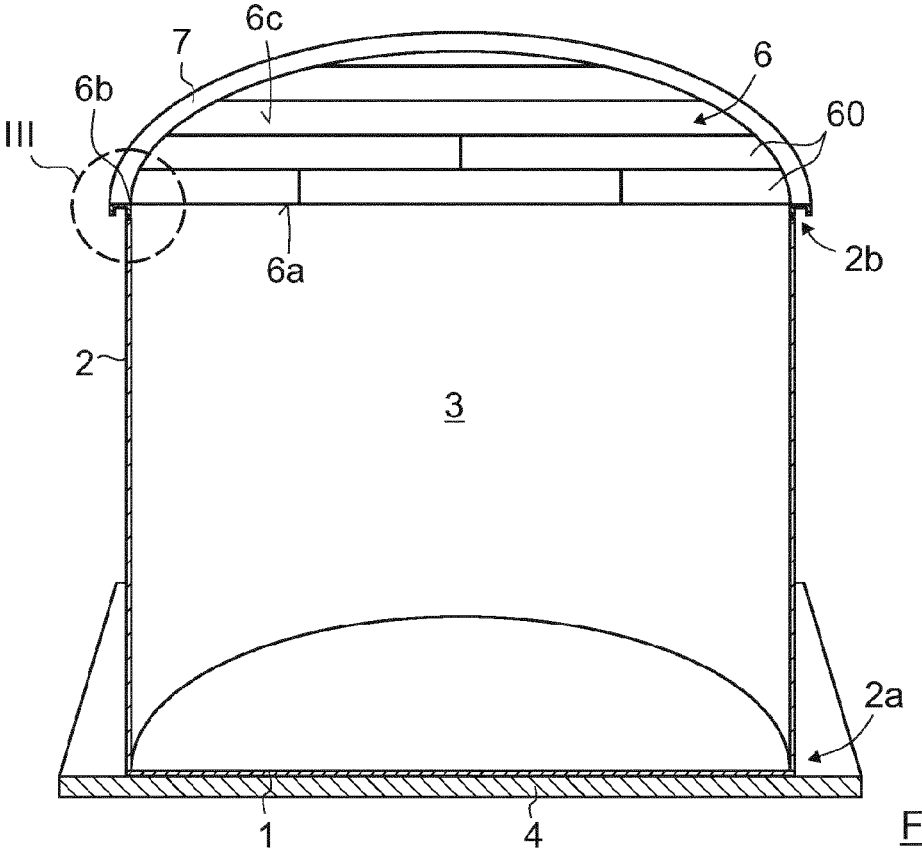
FIG. 2 shows a longitudinal section through a large container according to the invention.

FIG. 2 shows a longitudinal section through the large container shown schematically in FIG. 1.

As can be seen from FIGS. 1 and 2, the large container has a container base 1 and a circumferential container wall 2, which forms a receiving space 3 for the medium to be received. The medium to be received may, in principle, be a liquid, gaseous or solid medium.

The large container shown in the exemplary embodiment is suitable in a particularly advantageous way for solid and liquid media.

The large container shown in the exemplary embodiment is a drinking-water container, but the invention and the exemplary embodiment are not to be understood as being limited to this.

As can be seen from FIGS. 1 and 2, the container base 1 is arranged on a foundation 4. The foundation 4 can be, for example, a foundation made of steel-reinforced concrete. The container base 1 can preferably be produced from metal, in particular from steel. In the exemplary embodiment, production from stainless steel is envisaged.

The container wall 2 can be produced from concrete or steel-reinforced concrete. The container wall 2 can preferably be produced from metal, in particular steel. In the exemplary embodiment, the container wall is made of stainless steel.

In the exemplary embodiment, the container wall 2 is formed by helically bent sheet-metal webs 20 of stainless steel. It is preferable if the container wall 2 is produced by what is referred to as an endless strip method. The stainless steel webs or stainless steel strips used for this purpose are pre-profiled and welded together spirally on the inner side and on the outer side. In the exemplary embodiment, provision is made for the two weld seams to meet, with the result that a double weld with joined roots is formed. The sheet-metal webs 20 have integrally formed circumferential reinforcing ribs 5, as illustrated schematically in FIG. 1. As an option, however, the container wall 2 can also be designed to be smooth on the outer side (with the exception of any weld seams) or in some other way; this is not of essential importance within the scope of the invention. In principle, the container wall 2 can be produced in any desired manner, for example also in stages from individual sections. In the exemplary embodiment, the inner side of the container wall 2 is of edgeless design.

The container base 1 is preferably welded to a lower end 2*a* of the container wall 2.

As can furthermore be seen from FIGS. 1 to 6, an upper, open end 2*b* of the container wall 2 is closed by a container cover 6. In this case, the container cover 6 has at least a diameter of three meters (3 m).

In the exemplary embodiment, it is envisaged that the large container has a diameter of three meters to fifty meters (3 to 50 m), preferably five meters to forty meters (5 to 40 m), and therefore the container cover 6 also has a corresponding diameter. In the exemplary embodiment, it is furthermore envisaged that the receiving space 3 of the large container has a volume of from forty cubic meters to fifty thousand cubic meters (40 to 50,000 $m^3$), preferably a volume of from one hundred cubic meters to ten thousand cubic meters (100 to 10,000 $m^3$) in an embodiment as a drinking-water container.

The container wall 2 is preferably designed as a cylinder, in particular as a circular cylinder, as illustrated schematically in FIGS. 1 and 2.

Figure 3:
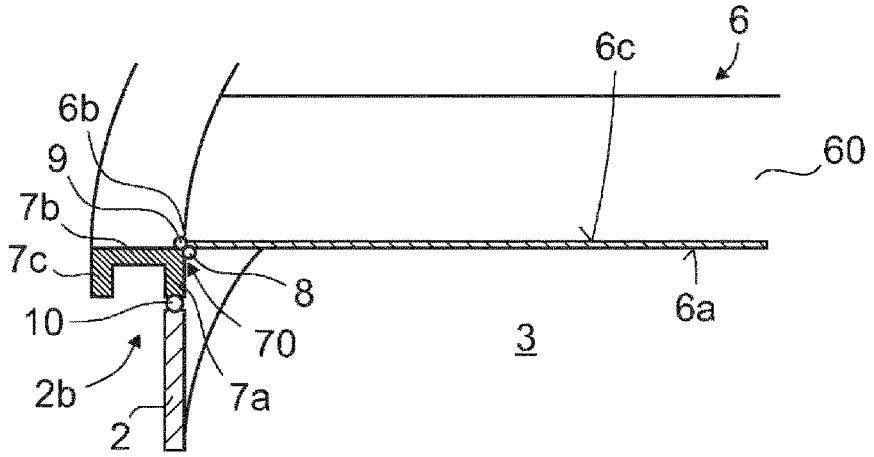
FIG. 3 shows a schematic illustration of detail III of FIG. 2 in a first embodiment.

As can be seen, in particular, from FIGS. 3 to 5, an annularly encircling support element 7 is fixed on an upper end region of the container wall 2, in the exemplary embodiment on the upper end 2*b* of the container wall 2.

According to the invention, the container cover 6 in the exemplary embodiment is designed as a metal disc which spans the upper, open end 2*b* of the container wall 2 in a self-supporting manner. The metal disc 6 closes the upper, open end 2*b* of the container wall 2 in that a lower side 6*a* of the metal disc 6, which side faces the receiving space 3, is welded in a gas-tight or liquid-tight manner to the support element 7 (compare FIGS. 3, 4*a*, 4*b*, 4*c* and 5*a*) and/or to the upper end region of the container wall 2 (compare FIG. 5*b*) by means of a continuous first weld seam 8. In particular, provision can be made for a circumferential edge 6*b* of the metal disc 6 to be appropriately welded to the support element 7 and/or to the end region of the container wall 2 (compare in particular FIGS. 3, 4*a* and 5*a*).

In addition, the circumferential edge 6*b* and/or an upper side 6*c* of the metal disc 6 can be welded to the support element 7 by means of a continuous second weld seam 9, as illustrated in FIGS. 3, 4*a*, 4*b* and 5*a*. As an alternative or in addition to a second weld seam 9, however, provision can also be made, for example, for the metal disc 6 to be additionally adhesively bonded, riveted or screwed to the support element 7. Purely by way of example and schematically, a screw 90 is indicated in this regard in FIG. 4*c*.

As can be seen from the figures, the metal disc 6 is arranged in such a way that it spans the upper, open end 2*b* of the container wall 2 while running horizontally. However, provision can also be made for the metal disc 6 to be designed to be curved, for example to be designed to be curved inward or outward. FIG. 1 shows three variants for the profile of the metal disc 6 by way of example in dashed lines.

Particularly in the case of the outwardly curved metal disc 6, but, where appropriate, also in the case of the horizontal or inwardly curved metal disc 6, a stabilizing means can optionally be provided (likewise shown in dashed lines in FIG. 1) in order to bring about bracing or stabilization of the metal disc 6, Nevertheless, the metal disc 6 can be self-supporting in the sense according to the invention.

Provision is preferably made for the metal disc 6 to be welded to the support element 7 without overlapping, as illustrated in particular in FIGS. 2, 3, 4*a* and 5*a*. In these exemplary embodiments, the outer diameter of the metal disc 6 substantially corresponds to the inner diameter of the support element 7. However, provision can also be made for the metal disc 6 to overlap the support element 7. Depending on the fastening technique, overlapping of the support element 7 can be advantageous, for example if, in addition to the first weld seam 8, an adhesive connection, riveted connection or screw connection is provided. By way of example, FIGS. 4*b*, 4*c* and 5*b* show exemplary embodiments of the invention with metal discs 6 that overlap the support element 7.

As can be seen in particular from FIGS. 3 to 5*b*, the support element 7 has, in cross section, at least two sections running at right angles to one another.

The support element 7 can be connected to the upper end region, in the exemplary embodiment the upper end 2*b* of the container wall 2, in such a way that a first section 7*a* of the support element 7 runs substantially parallel to the container wall 2 and is fixed on the container wall 2, and a second section 7*b* of the support element 7 runs substantially parallel to the metal disc 6, as illustrated in FIGS. 3 to 5*a*. In the exemplary embodiments mentioned, the annular support element 7 is welded to the upper end region of the container wall 2, or directly to the upper end 2*b* of the container wall 2, by means of a weld seam 10. The support element 7 thus extends the container wall 2 upward at the upper end 2*b*.

However, the support element 7 can also be secured on an outer side of the container wall 2, for example in such a way that the support element 7 preferably terminates at the same height as (but possibly also higher or lower than) the container wall 2. The support element 7 can thus form a collar in order to reinforce the container wall 2, for example as illustrated in FIG. 5*b*.

As can be seen from FIGS. 3 to 5*b*, the metal disc 6 is welded substantially to a transitional region 70 between the first section 7*a* and the second section 7*b* of the support element 7 by means of the first weld seam 8 and/or the second weld seam 9. In this case, the transitional region 70 may preferably be an edge, in particular an outer edge, of the support element 7.

Figure 4A:
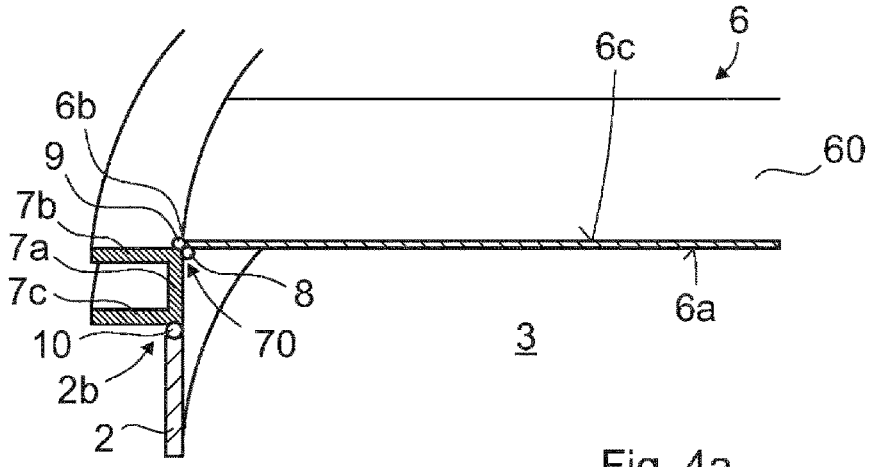
FIG. 4*a* shows a schematic illustration of section III of FIG. 2 in a second embodiment.
Figure 4B:
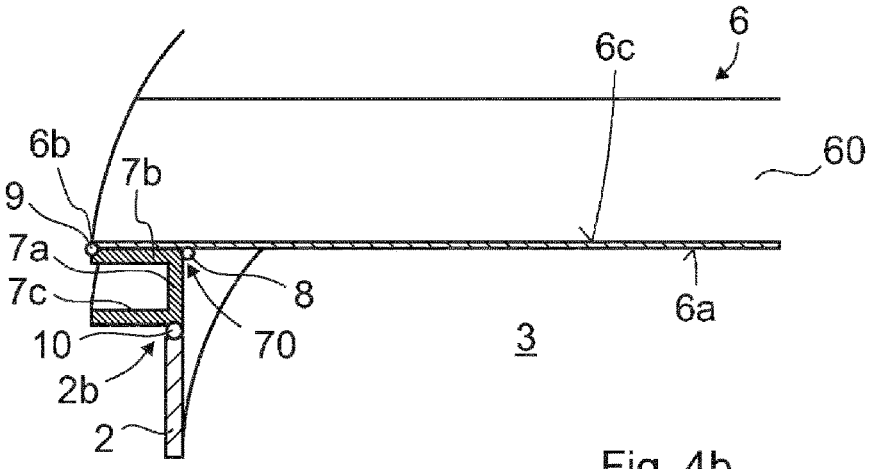
FIG. 4*b* shows a schematic illustration of detail III of FIG. 2 in a third embodiment.
Figure 4C:
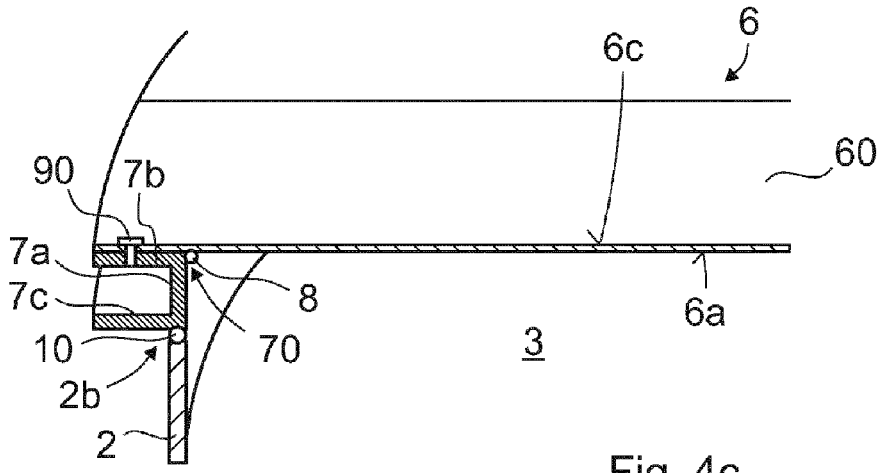
FIG. 4*c* shows a schematic illustration of detail III of FIG. 2 in a fourth embodiment.
Figure 5A:
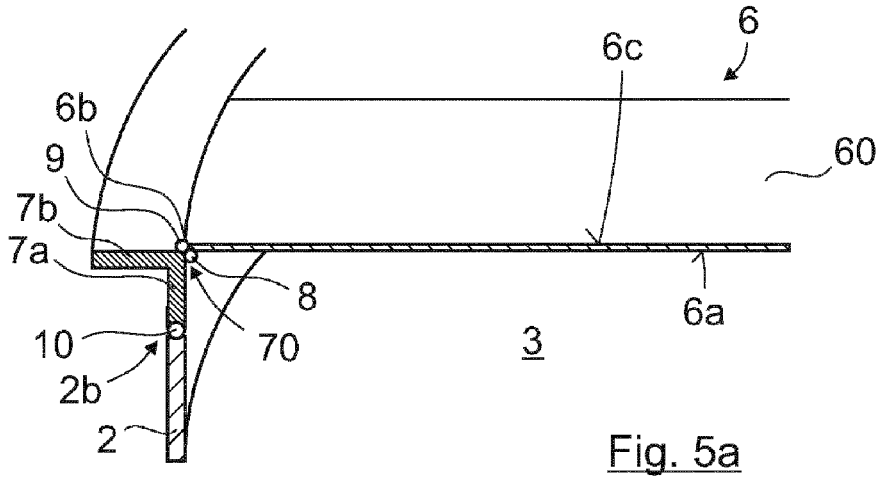
FIG. 5*a* shows a schematic illustration of section III of FIG. 2 in a fifth embodiment.
Figure 5B:
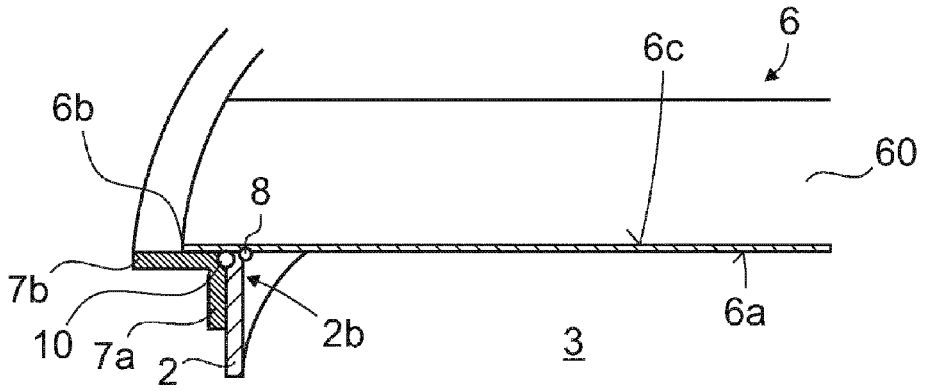
FIG. 5*b* shows a schematic illustration of detail III of FIG. 2 in a sixth embodiment.

As is indicated schematically in FIGS. 3, 4*a* and 5*a*, the first weld seam 8 and the second weld seam 9 can be set in such a way that a root of the first weld seam 8 and a root of the second weld seam 9 come together or merge into one another, with the result that a double weld seam with joined roots is formed.

In FIGS. 3 to 4*c*, a design of the support element 7 is illustrated in cross section as a U-profile. In FIGS. 5*a* and 5*b*, a design of the support element 7 is illustrated in cross section as an angle profile.

In principle, further profile geometries can also be provided. The specific geometry is not a matter of absolutely essential importance within the scope of the invention, although the U-profile and the angle profile, in particular, have proven to be advantageous. In principle, the support element 7 can thus be present in a variety of forms if they are suitable for enabling gas-tight or liquid-tight welding of the support element 7 both to the container wall 2 and to the metal disc 6.

The U-profile can be welded in various orientations to the container wall 2 and the metal disc 6. Two particularly preferred orientations of the support element 7 are illustrated in FIGS. 3 and 4*a*.

FIG. 3 shows an arrangement of the U-profile of the support element 7 in such a way that, when viewed in cross section, a third section 7*c*, which runs substantially parallel and at a distance from the first section 7*a*, adjoins that end of the second section 7*b* which faces away from the first section 7*a*.

FIGS. 4*a*-*c* show that the U-profile of the support element 7 is arranged in such a way that, when viewed in cross section, a third section 7*c*, which runs substantially parallel and at a distance from the second section 7*b*, adjoins that end of the first section 7*a* which faces away from the second section 7*b*.

In the exemplary embodiment, it is envisaged that, when viewed in a plan view, the metal disc 6 is designed as a circular disc since, when viewed in cross section, the container wall 2 is also designed as a circular ring. In principle, the metal disc 6 can have any desired shape. The shape of the metal disc 6 is selected in such a way that it is suitable for spanning the upper, open end 2*b* of the container wall 2 in a self-supporting manner and for closing it in that an edge 6*b* of the metal disc 6 is welded to the support element 7 by means of the two weld seams 8, 9.

The metal disc 6 being designed in such a way that it has the shape of a circular disc is particularly suitable for this purpose.

In the exemplary embodiment, the metal disc 6 is designed as a thin and flexible metal surface. Such thin and flexible metal surfaces are also referred to as diaphragm covers in the prior art.

Figure 6:
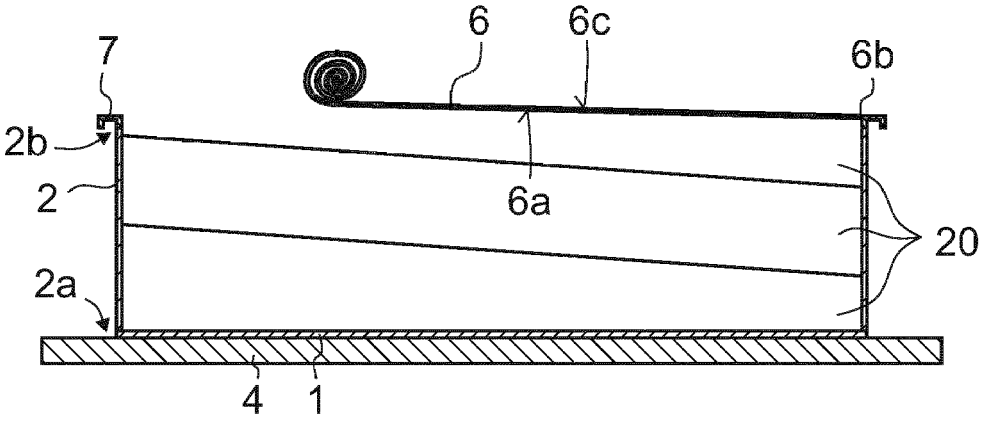
FIG. 6 shows a schematic illustration of the method for mounting the metal disc in such a way that it spans the upper, open end of the container wall in a self-supporting manner.

The metal disc 6 is configured in such a way that, as illustrated in FIG. 6, the metal disc 6 can preferably be rolled up to form a roll. In order to use the metal disc 6 as a flat cover for covering the upper end 2*b* of the container wall 2, the metal disc 6 is then preferably unrolled again at the construction site. This is preferably done by rolling out the metal disc 6 on the upper side of the container and welding it to the annular support element 7.

In a manner not shown in detail, provision can be made for the metal disc 6 to be tensioned in order to remove creases or to smooth the metal disc 6 before the metal disc 6 is welded to the support element 7.

In the exemplary embodiment, the metal disc 6 has a thickness of zero point five millimeters to four point zero millimeters (0.5 to 4.0 mm), preferably zero point five millimeters to three point zero millimeters (0.5 to 3.0 mm), more preferably zero point five millimeters to two point five millimeters (0.5 to 2.5 mm), more preferably zero point eight millimeters to two point five millimeters (0.8 to 2.5 mm), even more preferably one point zero millimeters to two point zero millimeters (1.0 mm to 2.0 mm) for example 1.5 mm.

As illustrated schematically in FIG. 2, the metal disc 6 is formed from a plurality of metal strips 60 or plates which are welded to one another and preferably run parallel to one another. Production in this way makes it possible to produce the metal disc 6 at low cost and individually in the desired shape or the desired diameter.

Figure 7:
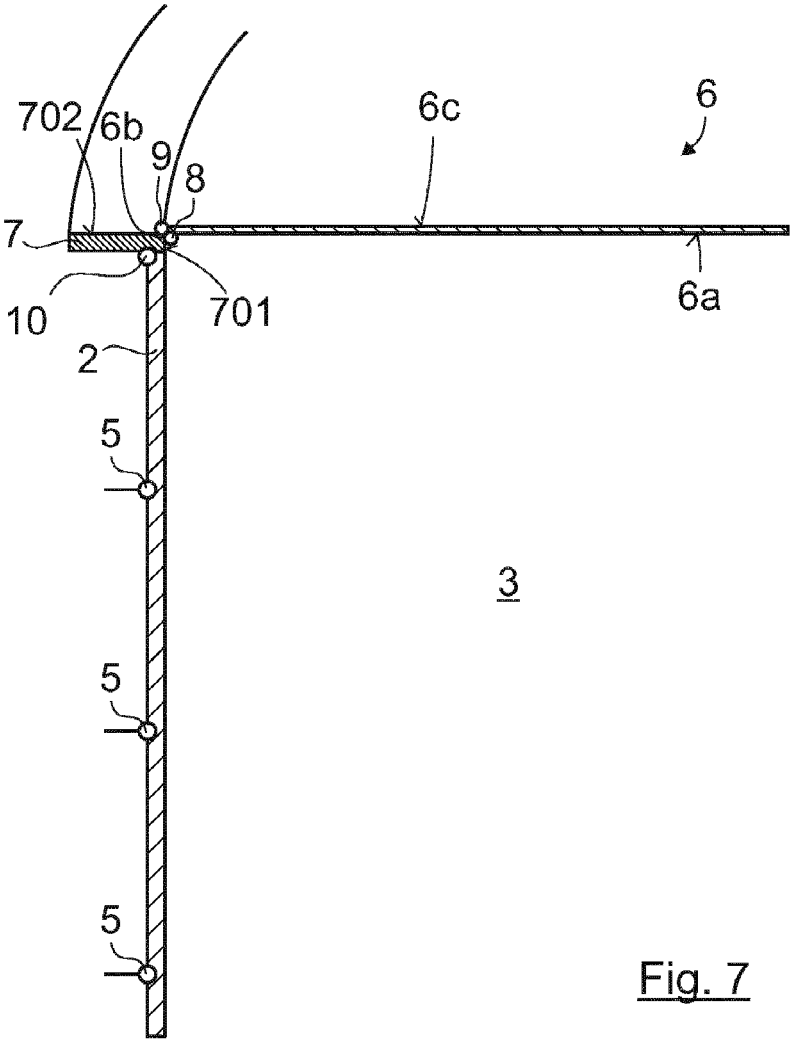
FIG. 7 shows another schematic illustration of a detail of an upper region of a large container according to the invention.

The exemplary embodiment according to FIG. 7 shows another advantageous embodiment of the support element 7 in cross section. In this case, the support element 7 has, in cross section, a first side 701 which runs substantially parallel to the container wall 2. The support element 7 furthermore has a side 702 which runs orthogonally thereto and which runs substantially parallel to the metal disc 6.

In the exemplary embodiment according to FIG. 7, the support element 7 has substantially the shape of a rectangle in cross section. In the exemplary embodiment according to FIG. 7, the support element 7 is a rectangle in cross section.

It has also proven advantageous if the support element 7 has substantially the shape of a triangle in cross section or is a triangle in cross section.

The support element 7 according to FIG. 7 can be connected to the metal disc 6 or the container wall 2 in the manner already described with reference to the exemplary embodiments according to FIGS. 4 to 5*b*. It is particularly advantageous if the support element 7 illustrated in FIG. 7 is welded by means of a continuous first weld seam 8 and by means of a continuous second weld seam 9, wherein the first weld seam 8 preferably welds a lower side 6*a* of the metal disc 6 to the support element 7 and the second weld seam 9 preferably welds an upper side 6*c* of the metal disc 6 to the support element 7. The weld seams 8, 9 are preferably set in such a way that a root of the first weld seam 8 and a root of the second weld seam 9 come together or merge into one another.

In FIG. 7, the support element 7 is preferably formed by a plurality of annular segments, which are connected to one another in such a way that the support element 7 according to the invention, which runs around in the form of a ring, is formed. The individual annular segments can preferably be connected to one another by adhesive bonding, riveting, screwing or welding.

Formation of the circumferential support element 7 by a plurality of annular segments is also suitable for the exemplary embodiments according to FIGS. 4 to 5*b*.

The support element 7 illustrated in FIG. 7 is preferably designed as an annular plate or formed by annular plate segments.

The support element 7 shown in FIG. 7 preferably has a height or thickness of ten millimeters to thirty millimeters (10 to 30 mm). Here, the thickness corresponds to the extent of the support element 7 along the first side 701.

The support element 7 illustrated in FIG. 7 furthermore has a width, i.e. an extent, starting from the side which adjoins the container wall 2 or extends it, in a direction orthogonal to the container wall 2 and thus along the second side 702, which is preferably one hundred millimeters to seven hundred millimeters (100 to 700 mm), in particular one hundred millimeters to six hundred millimeters (100 to 600 mm), particularly preferably three hundred millimeters to six hundred millimeters (300 to 600 mm).

The above description also serves to explain an exemplary embodiment for the method according to the invention. Placement of the metal disc 6 on the upper, open end 2*b* of the container wall 2, during which the metal disc 6 is initially present as a roll and is then unwound or unrolled, is illustrated in FIG. 6.

Welding of the metal disc 6 to the support element 7 and/or to the upper end region of the container wall 2 can preferably be accomplished in that, first, a circumferential gap between the lower side 6*a* of the metal disc 6, which side faces the receiving space 3, and the support element 7 and/or the upper end region of the container wall 2 is welded (first weld seam 8). In addition, the upper side 6*c* of the metal disc 6 and/or its circumferential edge 6*b* can then be welded to the support element 7 by means of the continuous second weld 9. Welding is preferably carried out in such a way that a double weld with joined roots is obtained.

An advantageous method according to the invention for producing a large container can preferably comprise the following steps:

- preparation of the foundation 4 on which the container base 1 is placed. The container base 1 can in this case be formed from a plurality of metal strips, which are welded together.
- creation of the container wall 2. Here, the container wall 2 can preferably be formed by the helically bent sheet-metal webs 20, it being possible to use the endless strip method.
- welding of the support element 7 to the upper end 2*b* of the container wall 2, preferably when the container wall 2 has reached a height of 1 to 4 m, preferably 2 to three meters (3 m).
- rolling out the metal disc 6, wherein the metal disc 6 is preferably produced from metal strips 60 welded together.
- welding of the metal disc 6 by means of the first weld seam 8 and additionally by means of the second weld seam 9 to the support element 7 and/or to the upper end region of the container wall 2 (as described), preferably in such a way that a double weld joined at the roots is obtained.
- optionally setting a second weld seam 9 in such a way that the root of the second weld seam 9 comes together with the root of the first weld seam 8, which is set from below.

In the exemplary embodiment, provision can be made finally for a bitumen layer or the like to be applied to the upper side 6*c* of the metal disc 6 and for this layer to be weighed down with gravel or the like.

The metal disc 6, the container wall 2, the support element 7 and the container base 1 are preferably formed from the same material, preferably a weldable material, in particular steel, preferably stainless steel. In principle, any desired weldable material combinations can be provided. In the exemplary embodiment, it is envisaged that high-alloy, austenitic and ferritic-austenitic stainless steels, preferably with the material numbers 1.4404, 1.4571, 1.4162 or 1.4462, are used as the material.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A container, comprising:

a container base;

a circumferential container wall which forms a receiving space, the container wall having an upper end;

a support element fixed on the upper end of the container wall, the support element annularly encircling the container wall;

a cover which comprises a metal disc which spans the upper end of the container wall and closes the upper end of the container wall, the metal disc spanning the upper end of the container wall supported only by the support element and the metal disc itself;

the metal disc having a lower side which faces the receiving space, the lower side of the metal disc being welded in a gas-tight or liquid-tight manner to the support element and/or to the upper end of the container wall by a continuous first weld seam which has a first root; the metal disc having an upper side and an edge, the upper side and/or the edge of the metal disc being welded to the support element by a continuous second weld seam which has a second root, the first root and the second root coming together.

2. A container as claimed in claim 1, wherein the metal disc runs horizontally.

3. A container as claimed in claim 1, wherein the metal disc is welded to the support element without overlapping the support element.

4. A container as claimed in claim 1, wherein the metal dise has an outer diameter which substantially corresponds to an inner diameter of the support element.

5. A container as claimed in claim 1, wherein the support element has, in cross section, a first side which runs substantially parallel to the container wall, the support element also having, in cross section, a second side which runs orthogonally to the container wall and runs substantially parallel to the metal disc, the support element having, in cross section, substantially the shape of a rectangle.

6. A container as claimed claim 1, wherein the support element has, in cross section, at least a first section and a second section, the first section and the second section running at right angles to one another, and wherein the support element is connected to the upper end of the container wall such that the first section of the support element runs substantially parallel to the container wall and is fixed on the container wall and the second section of the support element runs substantially parallel to the metal disc.

7. A container as claimed in claim 6, wherein the metal disc is welded to a transitional region between the first section and the second section of the support element by the first weld seam and/or the second weld seam.

8. A container as claimed in claim 1, wherein the support element has a cross-sectional profile which is either a U-profile or an angle profile.

9. A container as claimed in claim 8, wherein the cross-sectional profile of the support element is a U-profile which is arranged such that, when viewed in cross section, an end of the first section of the support member which faces away from the second section of the support member is adjoined by a third section of the support member, the third section running substantially parallel to the second section.

10. A container as claimed in claim 8, wherein the cross-sectional profile of the support element is a U-profile which is arranged such that, when viewed in cross section, an end of the second section of the support member which faces away from the first section of the support member is adjoined by a third section of the support member, the third section running substantially parallel to the first section.

11. A container as claimed in claim 1, wherein the support element is connected to the upper end of the container wall by material bonding and/or by nonpositive engagement.

12. A container as claimed in claim 1, wherein the first root of the first weld seam and the second root of the second weld seam merge into one another.

13. A container as claimed in claim 1, wherein the metal disc is thin and flexible.

14. A container as claimed in claim 1, wherein the metal disc is configured in such a way that the metal disc can be rolled up to form a roll and can be rolled out again in order to cover the upper end of the container wall.

15. A container as claimed in claim 1, wherein the metal dise is tensioned radially before being welded.

16. A container as claimed in claim 1, wherein the metal disc has a thickness of 0.5 to 4.0 mm.

17. A container as claimed in claim 1, wherein the metal disc is formed from a plurality of metal strips which are welded to one another.

18. A container as claimed in claim 1, wherein the container wall is a circular cylinder.

19. A container as claimed in claim 1, wherein the container wall is formed from helically bent sheet-metal webs.

* * * * *